US005997112A

United States Patent [19]

Karten et al.

[11] Patent Number: 5,997,112

[45] **Date of Patent: *Dec. 7, 1999**

[54] MULTIPURPOSE STORAGE CASE AND DISPLAY CABINET

[75] Inventors: Stuart Karten, Venice; Michael J. Rocha, Los Angeles; Robert Blumenfeld, Sherman Oaks; Dennis Schroeder, Hermosa Beach; Paul Kirley, Santa Monica, all of Calif.

[73] Assignee: Abex Display Systems, North Hollywood, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,990

[22] Filed: Sep. 2, 1997

[51] Int. Cl.[6] ..... A47B 81/00

[52] U.S. Cl. ..... 312/140.2; 312/290; 312/217; 312/313

[58] Field of Search ..... 312/140.1, 140.2, 312/140.3, 140.4, 290, 291, 217, 218, 304, 310, 313, 325; 108/64, 65, 69

[56] References Cited

U.S. PATENT DOCUMENTS

| | | | |
|---|---|---|---|
| 509,653 | 11/1893 | Coleman . | |
| 747,741 | 12/1903 | Marsh . | |
| 1,702,996 | 4/1929 | Coppage . | |
| 1,997,241 | 4/1935 | Templin . | |
| 2,058,682 | 10/1936 | Green | 312/290 X |
| 2,115,422 | 4/1938 | Kahle | 312/217 |
| 2,118,735 | 5/1938 | Money | 312/291 X |
| 2,486,460 | 11/1949 | Bonenberger | 312/217 X |
| 2,489,493 | 11/1949 | Kuenzie | 312/140.3 X |
| 2,602,252 | 7/1952 | Shinn . | |
| 3,010,775 | 11/1961 | Giovannelli | 312/290 X |
| 3,087,767 | 4/1963 | Schell | 312/290 X |
| 3,186,781 | 6/1965 | Lax . | |
| 3,510,187 | 5/1970 | Schreyer | 312/304 |
| 3,672,741 | 6/1972 | Clark | 312/140.2 X |
| 3,826,206 | 7/1974 | Ruggles | 108/64 |
| 4,400,043 | 8/1983 | Rossow . | |
| 4,417,774 | 11/1983 | Bevan et al. . | |
| 4,436,353 | 3/1984 | Tucker . | |
| 4,591,215 | 5/1986 | Robbins . | |
| 4,652,062 | 3/1987 | Greenwood . | |
| 4,786,122 | 11/1988 | Nichoalds . | |
| 4,819,567 | 4/1989 | Thompson et al. . | |
| 4,820,003 | 4/1989 | Lloyd . | |
| 4,893,885 | 1/1990 | Borello . | |
| 5,162,028 | 11/1992 | Wilkinson | 108/65 X |
| 5,207,723 | 5/1993 | Newby, Sr. . | |
| 5,402,738 | 4/1995 | Carr et al. . | |
| 5,486,043 | 1/1996 | Carr et al. | 312/235.1 |
| 5,590,939 | 1/1997 | Piontek . | |
| 5,718,494 | 2/1998 | Luddemann . | |
| 5,873,643 | 2/1999 | Burgess, Jr. et al. | 312/290 |

FOREIGN PATENT DOCUMENTS

| | | | |
|---|---|---|---|
| 315050 | 7/1929 | United Kingdom | 312/290 |
| 0628310 | 8/1949 | United Kingdom | 312/265.4 |
| 807047 | 1/1959 | United Kingdom | 312/290 |

OTHER PUBLICATIONS

Abex Display Systems International, Exposure Catalog.
"Your Competitive Edge"; Skyline Displays and Graphics.
Nomadic Instand, "Counters RollEase Counter", Counters and Table, p. 2, Jun. 1996.

*Primary Examiner*—Jose V. Chen
*Assistant Examiner*—Hanh V. Tran
*Attorney, Agent, or Firm*—Raymond Sun

[57] ABSTRACT

A storage case has a plurality of walls surrounding an internal compartment, a door provided in a front wall for providing access to the internal compartment, a top panel for covering the internal compartment, and a removable table top assembly resting on the top panel. The table top assembly has a plurality of table top panels that are removably coupled together to form the table top assembly, and which are adapted to be stored in the internal compartment. The storage case further includes a base panel between the plurality of walls, and a set of wheels provided adjacent the base panel. A shelf may be provided in the internal compartment when the storage case is used as a combined storage cabinet and table top. The storage case is especially adapted for use in storing components are that used to assemble a modular display system.

25 Claims, 6 Drawing Sheets

MULTIPURPOSE STORAGE CASE AND DISPLAY CABINET

BACKGROUND OF THE INVENTION

1. Field of the Invention

The present invention relates to storage cases for use in storing and transporting modular display systems, and in particular, to a multipurpose storage case which can be used not only for storing and transporting the components of modular display systems, but also as a complete display table and storage cabinet for use at a trade show.

2. Description of the Prior Art

Modular display systems are commonly used at trade shows or exhibitions to display or exhibit photographs, promotional material, product samples, messages and other communication media. A conventional modular display system typically includes display frames that are provided in the form of tubings, panels that are typically made of a strong durable fabric material, and lighting assessories. The tubings, fabric and lighting are usually provided in separate pieces that are packed and stored in a storage case for transportation to the site of the trade show or exhibit. These components are then assembled at the site to create the display system.

Since these display systems are often required to display large communication media such as promotional literature and photographs, these display systems are necessarily large and bulky. To assemble a large display system requires a large number of components, and in particular, the tubings, the fabric and the lighting. This in turn requires a large storage case that can accomodate all of the components required to assemble the desired display system.

There are many currently-available storage cases that have been designed to accomodate all of these components. Since they are large and bulky, it is often troublesome to find a good location to store these cases after the components stored therein have been removed and used to assemble the display system.

In addition to a display system, exhibitors at a trade show typically will need to rent or otherwise obtain tables that are used as working areas adjacent the displays, and storage cabinets that are used to store additional written documents, samples and other materials. Exhibitors will need to incur additional hassles and costs to obtain these tables and storage cabinets.

Most of the existing modular display systems and storage cases have focused on providing more convenience to exhibitors in storing, transporting, assembling and disassembling modular display systems. However, there is also a need to provide added convenience to exhibitors at the trade show or exhibition, after the display system has been set up and when it is in use. This need has not always been addressed by the currently available display systems and storage cases.

SUMMARY OF THE DISCLOSURE

In view of the foregoing, it is an object of the present invention to provide exhibitors with added convenience at a trade show or exhibition after the display system has been set up and when it is in use.

It is a further object of the present invention to minimize or eliminate the cost and hassles experienced by exhibitors in obtaining tables and storage cabinets for use at the trade show or exhibition.

It is yet a further object of the present invention to provide a storage case that can also be used as both a table and a storage cabinet when the display system is in use.

It is another object of the present invention to provide a storage case having a removable enlarged table top to provide increased working area at a trade show or exhibition, with the table top capable of being conveniently disassembled and stored in the storage case for transportation.

It is yet another object of the present invention to provide a storage case having a front door, internal compartments, and shelves that allow the storage case to be conveniently used for storing promotional literature and other materials at a trade show or exhibition.

It is also an object of the present invention to provide a storage case having a door that provides for convenient accessibility to items stored inside the storage case when the storage case is used as a storage cabinet and table.

In order to accomplish the objects of the present invention, there is provided a storage case that has a plurality of walls surrounding an internal compartment, a door provided in a front wall for providing access to the internal compartment, a top panel for covering the internal compartment, and a removable table top assembly resting on the top panel. The table top assembly has a plurality of table top panels that are removably coupled together to form the table top assembly, and which are adapted to be stored in the internal compartment. The storage case of the present invention is especially adapted for use in storing components are that used to assemble a modular display system.

The storage case according to the present invention further includes a base panel between the plurality of walls, and a set of wheels provided adjacent the base panel. A shelf may be provided in the internal compartment when the storage case is used as a combined storage cabinet and table top. The shelf may include a lever arm pivotably coupling the shelf and one of the plurality of walls inside the internal compartment, with the shelf pivoted between a vertical position adjacent the front wall, and a horizontal position across the internal compartment.

The storage case according to the present invention may further include a lid hingedly connected to one of the walls, the lid including the top panel. The storage case may also include a handle provided on one of the walls.

The door of the storage case has a hollow interior and may include a locking mechanism. The locking mechanism has a locking wheel having a pair of bars extending vertically in opposite directions from the wheel, each bar housed within the hollow interior of the door and, when the lock is activated, is extended from the hollow interior and into the internal compartment adjacent the front wall to prevent the door from being opened. The locking mechanism further includes a lock and a lever arm having a first end coupled to the locking wheel and a second end having a finger for locking engagement with the lock.

The table top panels according to the present invention include a bottom surface and a plurality of recesses on the bottom surface, each recess having two wall sections separated by a bottom section, with the wall sections of adjacent recesses defining a channel. The two wall sections of each recess are angled with respect to each other such that the two wall sections are closest to each other adjacent the bottom section and furthest from each other adjacent the bottom surface of the table top panel. A plurality of tubes are provided and received inside the channels of adjacent table top panels to connect these table top panels to assemble the complete table top. A plurality of ridges are provided on the top panel for insertion into corresponding recesses on the bottom surfaces of the table top panels, to securely retain the table top panel on top of the storage case.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

The storage case according to the present invention provides for multiple uses. It is used primarily to store all the components of a modular display system for transportion from one location to another. In addition, the storage case of the present invention is also configured so that it can be used as a storage cabinet at a trade show or exhibition, and as a base support for a removable table top which provides an enlarged working area. In this regard, the storage case of the present invention is provided with an internal compartment or enclosed space having a shelf for holding and storing written and other materials, and a front door for permitting access to the internal compartment.

Figure 1:
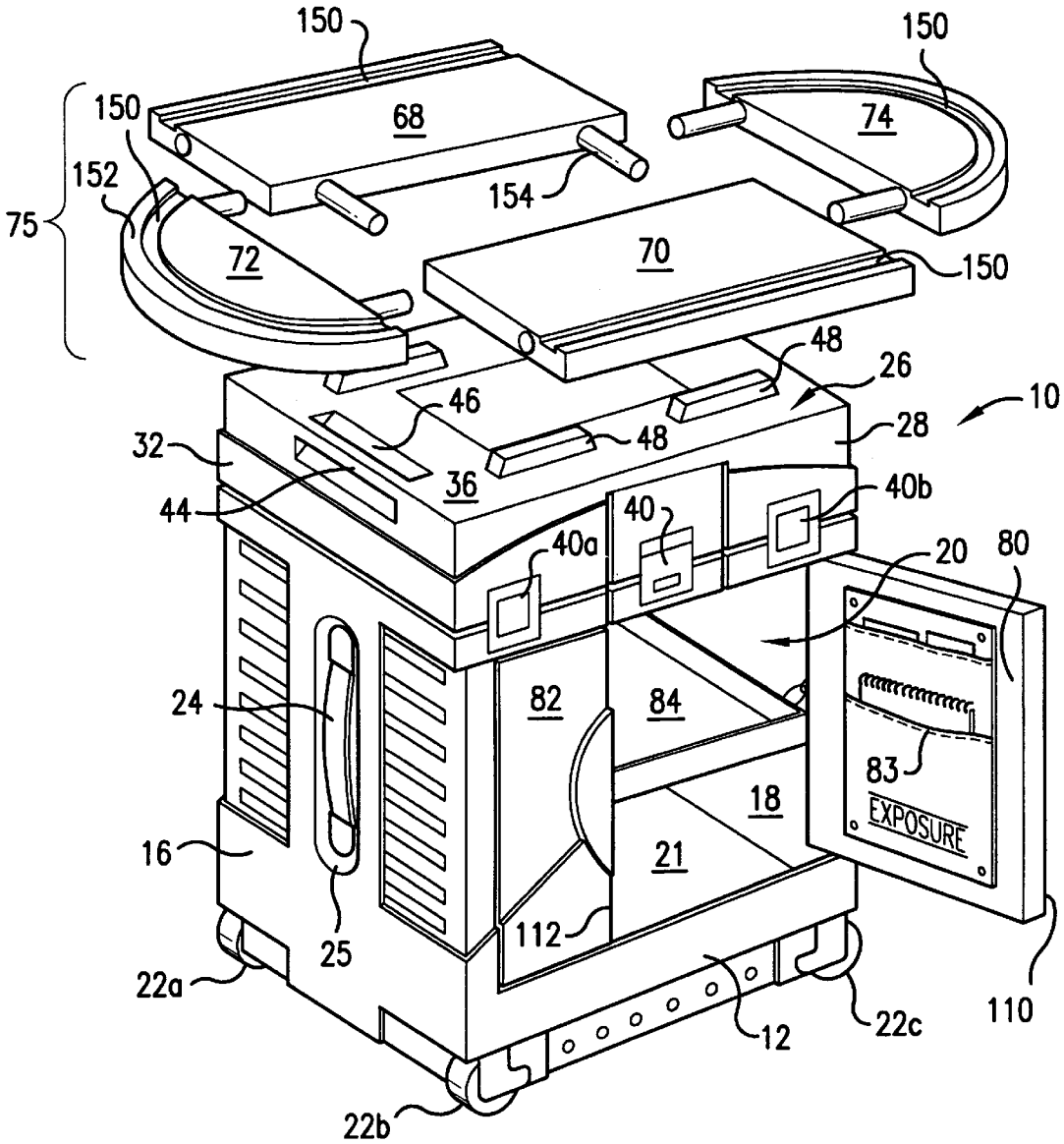
FIG. 1 is an exploded perspective view of the storage case of the present invention shown in use as a display cabinet and table.
Figure 2:
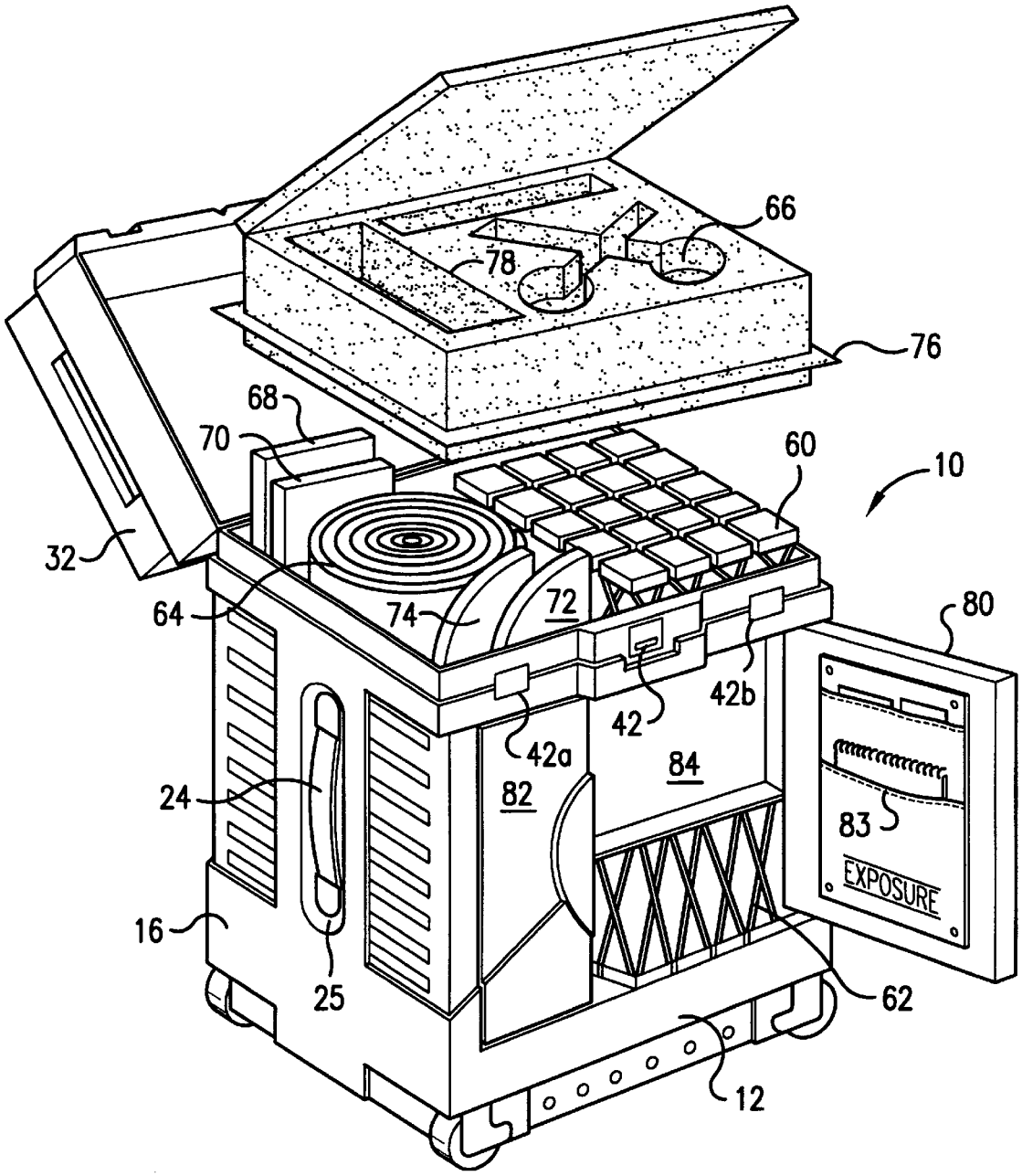
FIG. 2 is an exploded perspective view of the storage case of FIG. 1 illustrating how the various components of a modular display system are stored therein.
Figure 3:
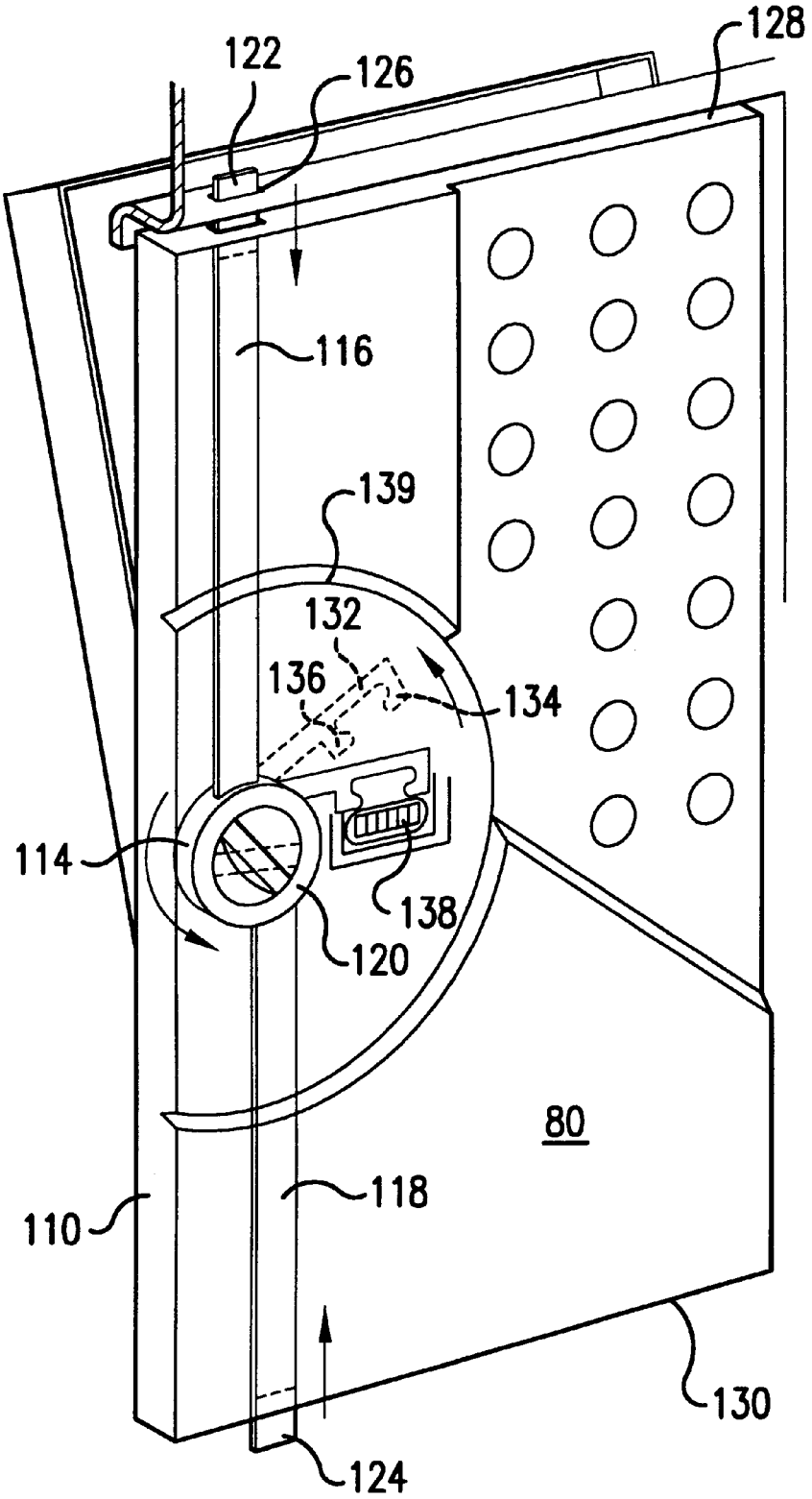
FIG. 3 is a sectional view of a front door of the storage case of FIG. 1 and its associated locking mechanism.
Figure 4:
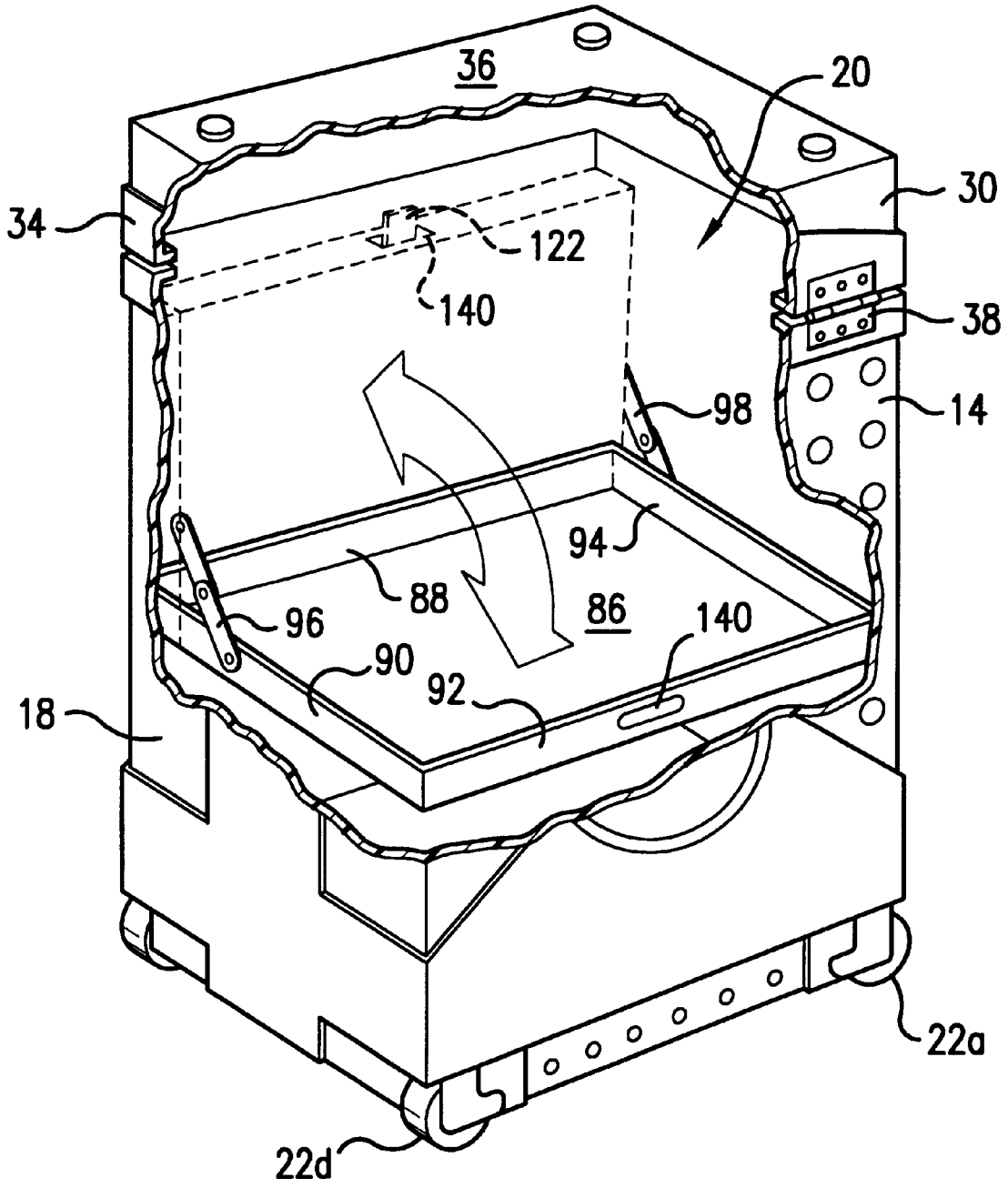
FIG. 4 is a sectional cut-away view of the storage case of FIG. 1 illustrating its self-deployable shelf.

An embodiment of a storage case 10 according to the present invention is illustrated in FIGS. 1–6. Referring to FIGS. 1, 2 and 4, the storage case 10 has a front wall 12 and a rear wall 14 connected by two side walls 16 and 18 to define an internal compartment 20 or enclosed space. A base panel 21 extends across the bottom sides of the walls 12, 14, 16 and 18. Four wheels or casters 22*a*, 22*b*, 22*c* and 22*d* are provided at the four bottom corners of the walls 12, 14, 16 and 18 by any known method. For example, one axle (not shown) can extend across the internal compartment 20 adjacent the side wall 16 to connect a pair of wheels 22*a* and 22*b*, and another axle (not shown) can extend across the internal compartment 20 adjacent the side wall 18 to connect another pair of wheels 22*c* and 22*d*. As another example, the wheels 22*a*, 22*b*, 22*c* and 22*d* can be rotatably coupled to the bottom corners of the walls 12, 14, 16 and 18. The internal compartment 20 defined by the walls 12, 14, 16 and 18 has an open top. One or more gripping handles 24 can be provided along side walls 16 and 18 (or any of the other walls) to allow gripping control of the storage case 10 during transportation. In a non-limiting embodiment of the present invention, the gripping handle 24 is provided inside a recess 25 in side wall 16 and is a strap having opposite ends secured to the side wall 16. In addition, a pair of doors 80 and 82 are provided in the front wall 12 to provide access to the internal compartment 20, as described in greater detail hereinbelow.

The storage case 10 further includes a cover or lid 26 that covers the open top of the internal compartment 20. The lid 26 also has a front wall 28 and a rear wall 30 connected by two side walls 32 and 34, and a top panel 36 extending across the top sides of the walls 28, 30, 32 and 34. Hinges 38 connect the rear walls 14 and 30. Complementary locking mechanisms 40 and 42 are provided on the front walls 28 and 12 to secure the lid 26 to the front wall 12. In a non-limiting embodiment of the present invention, the complementary locking mechanisms 40 and 42 can be a conventional latch 42 and keeper 40 combination, with the keeper 40 attached to the front wall 28 of the lid 26, and the latch 42 attached to the front wall 12. Two other pairs of keepers and latches 40*a*, 42*a* and 40*b*, 42*b* may be provided on either side of the primary keeper 40 and latch 42. The primary keeper 40 and latch 42 may be provided with a locking combination for locking the lid 26 to the front wall 12. In addition to the keepers and latches described above, other conventional locking mechanisms, including but not limited to rotary latches, over-center latches, draw latches and tension latches can also be used. Handle grips 44 can be molded or otherwise provided along side walls 32 and 34 of lid 26 to facilitate gripping control of the storage case 10 during transportation. In a non-limiting embodiment of the present invention, the handle grip 44 is actually a handle bar that is formed by providing a through-slot 46 in the lid 26 between the top panel 36 and the side wall 32, so that a person can pass his or her fingers through the slot 46 to grip the handle bar 44. A plurality of ridges 48, whose functions are described in greater detail hereinbelow, are provided on the top panel 36.

FIG. 2 illustrates the storage case 10 in use as a storage medium for the components of a modular display system. These components include a plurality of collapsible frames 60, each having a plurality of foldable legs 62. The foldable legs 62 can be formed from tubular members, as is well-known in the art. In addition, the components of a modular display system further include a plurality of fabric panels 64, and lighting accessories 66. These components are stored in the internal compartment 20 in an organized and secure manner, together with the table top panels 68, 70, 72 and 74 that are used to form a table top 75, as described in greater detail hereinbelow. For example, the frames 60 and their legs 62 are collapsed to their smallest configuration and are arranged vertically on one side of the internal compartment 20. The fabric panels 64 may be rolled into a unitary roll and placed vertically or in an upright manner on the other side of the internal compartment. The fabric panels 64 may include a decorative skirt 65 that is used to cover the sides of the storage case 10 when it is being used as a combined storage cabinet and table. The table top panels 68, 70, 72 and 74 can be placed vertically on both sides of the roll of fabric panels 64. Finally, the lighting asccessories 66 are preferably stored in a box 76. In a non-limiting embodiment, the box 76 is provided completely in foam with a plurality of cut-outs 78 in which the lighting accessories 66 may be stored. A foam box 76 provides effective protection against damage for the usually fragile lighting accessories 66. The box 76 may be positioned above the frames 60, the fabric panels 64 and the table top panels 68, 70, 72 and 74, in the space defined by the walls 28, 30, 32 and 34 of the lid 26.

Although FIG. 2 illustrates a particular arrangement for the components of the modular display system, those skilled in the art will appreciate that the arrangement is not critical, and can be varied without departing from the spirit and scope of the present invention. For example, the arrangement depends in part on the configuration of the components of the storage case 10, since different configurations of the components may be used in the storage case 10, thereby requiring a different arrangement.

Thus, the storage case 10 according to the present invention provides secure and effective storage for the components of the display system. The wheels 22*a*, 22*b*, 22*c*, 22*d* and the handles 24 and 44 facilitate convenient transportation of the storage case 10 and the components stored therein.

FIG. 1 now illustrates the storage case 10 in use as a combined table and storage cabinet at a trade show or exhibition. At this time, the components of the modular display system have been removed from the internal compartment 20 and the modular display system assembled at the exhibition site. The lid 26 is closed and the storage case 10 rested on the ground at an orientation with its wheels 22*a*, 22*b*, 22*c* and 22*d* in contact with the ground. Since the lid 26 is closed, the doors 80 and 82 may be opened to provide access to the internal compartment 20. One or more pockets 83 may be provided on the internal surface of the doors 80 and 82. A shelf or tray 84 is positioned horizontally at about the center of the internal compartment 20 to provide separate shelf or storage spaces (i.e., the base panel 21 and the shelf 84) for written materials, samples and other materials. The table top panels 68, 70, 72 and 74 may be assembled in the manner described below and seated on the top panel 36 of the lid 26 to provide an enlarged or widened table top 75 for use as a working area. Thus, as illustrated in FIG. 1, the storage case 10 can simultaneously function as a storage cabinet that includes shelf space for materials, and as a base or support for a table top 75.

In addition, although the storage case 10 is illustrated as having two doors 80, 82, it is possible to provide the storage case 10 with only one door on the front wall 12, or to provide a door in the rear panel 14 in addition to or in lieu of the door(s) on the front wall 12. Such a door in the rear panel 14 can provide the exhibitor with access to the internal compartment 20 without the need to walk to the front of the storage case 10.

The structure and operation of one non-limiting embodiment of the shelf or tray 84 will now be illustrated with reference to FIG. 4. The shelf 84 may take the form of a tray having a bottom panel 86 and four surrounding walls that include a front wall 88, a rear wall 92, and two side walls 90 and 94. The front corners of the shelf 84, which are defined by the connecting corners of the front wall 88 and the side walls 90 and 94, are pivotally connected to the side walls 16 and 18 of the storage case 10 by a rivet. In addition, a pair of lever arms 96 and 98 each has one end connected to the side walls 90 and 92, respectively, of the shelf 84, and a second end connected to the side walls 18 and 16, respectively, of the storage case 10. The lever arms 96 and 98 operate to pivot or fold the shelf 84 upwardly to a vertical position or downwardly to a horizontal position. When the storage case 10 is used to store the components of the modular display system, the shelf 84 is folded up in the vertical position against the front wall 12, as illustrated in FIG. 2 and in phantom in FIG. 4. When the shelf 84 is to be used, it is folded down to the horizontal position as shown in FIGS. 1 and 4. Thus, the shelf 84 remains securely attached to the interior compartment 20 of the storage case 10.

Alternatively, a separate shelf that is not connected to the storage case 10 can be provided, and appropriate catches, grooves or other mechanisms provided in the internal compartment 20 for receiving the shelf when it is deployed. The separate shelf can be stored during transportation by inserting it vertically into the internal compartment 20 from the top when the lid 26 is opened. This separate shelf can be provided in addition to or in lieu of the shelf 84 described hereinabove.

The structure and operation of one non-limiting embodiment of a locking mechanism for the doors 80 and 82 will now be illustrated with reference to FIG. 3. The doors 80 and 82 are configured such that they have overlapping side edges 110 and 112, respectively, so that the side edge 110 of door 80 overlaps the side edge 112 of door 82 (see also FIG. 1). As a result, door 82 can be closed first, and when door 80 is then closed, the overlapping side edge 110 of door 80 will cover the overlapping side edge 112 of door 82 to keep the door 82 secured and to prevent the door 82 from opening. The locking mechanism includes a locking wheel 114 having bars 116 and 118 extending vertically in opposite directions from the wheel 114. The locking wheel 114 and the bars 116, 118 are deployed inside the hollow interior of the door 80 so that they are not visible to the user. The locking wheel 114 has a knob 120 that extends outside the front surface of the door 80 so that the user can turn the wheel 114. Each end 122 and 124 of the bars 116 and 118, respectively, extends through an opening 126 at the upper side 128 and the lower side 130, respectively, of the door 80. A lever 132 has one end connected to the locking wheel 114 to control the locking wheel 114 and the bars 116, 118. The other end of the lever 132 has two fingers 134 and 136 which are adapted to be received inside a lock 138. The lock 138 may be a conventional combination lock. The front surface of the door 80 may be provided with contours 139 to provide the knob 120 of the locking wheel 114 and the lever 132 in an aesthetically pleasing manner.

In use, the locking mechanism is activated by turning the knob 120 clockwise to fit the fingers 134 and 136 of the lever 132 inside the lock 138. When the knob 120 is turned clockwise, the bars 116 and 118 extend vertically away from the locking wheel 114 and through the openings 126 into the internal compartment 120 of the storage case 10, adjacent the inner surface of the front wall 12. This secures the door 80 with respect to the storage case 10, and prevents the door 80 from being opened. In addition, the upper end 122 of the upper bar 116 also extends through an opening 140 in the rear wall 92 of the shelf 84 (as shown in phantom in FIG. 4), to further secure the shelf 84 against the front wall 12 of the storage case 10. The lock 138 can then be set to prevent the lever 132 from being inadvertently moved. To unlock the door 80, the knob 120 is turned counterclockwise to lift the lever 132, thereby releasing the fingers 134, 136 from the lock 138 and causing the bars 116 and 118 to extend vertically away from the openings 126.

The structure of one non-limiting embodiment of the table top panels, and the assembly of a table top 75, will now be illustrated with reference to FIGS. 1 and 5. Four panels 68, 70, 72 and 74 may be provided, which include two center panels 68 and 70, and two end panels 72 and 74. End panels 72 and 74 may have rounded edges to provide an oval-shaped table top. In addition, the upper surfaces of the panels 68, 70, 72 and 74 may be provided with a channel 150 that extends around the assembled table top 75 and which defines a margin 152 along the side edges of the assembled table top 75. The panels 68, 70, 72 and 74 are held together by inserting a plurality of tubes 154, acting a dowels, into corresponding channels 156 that are configured to securely grip the tubes 154.

Figure 5:
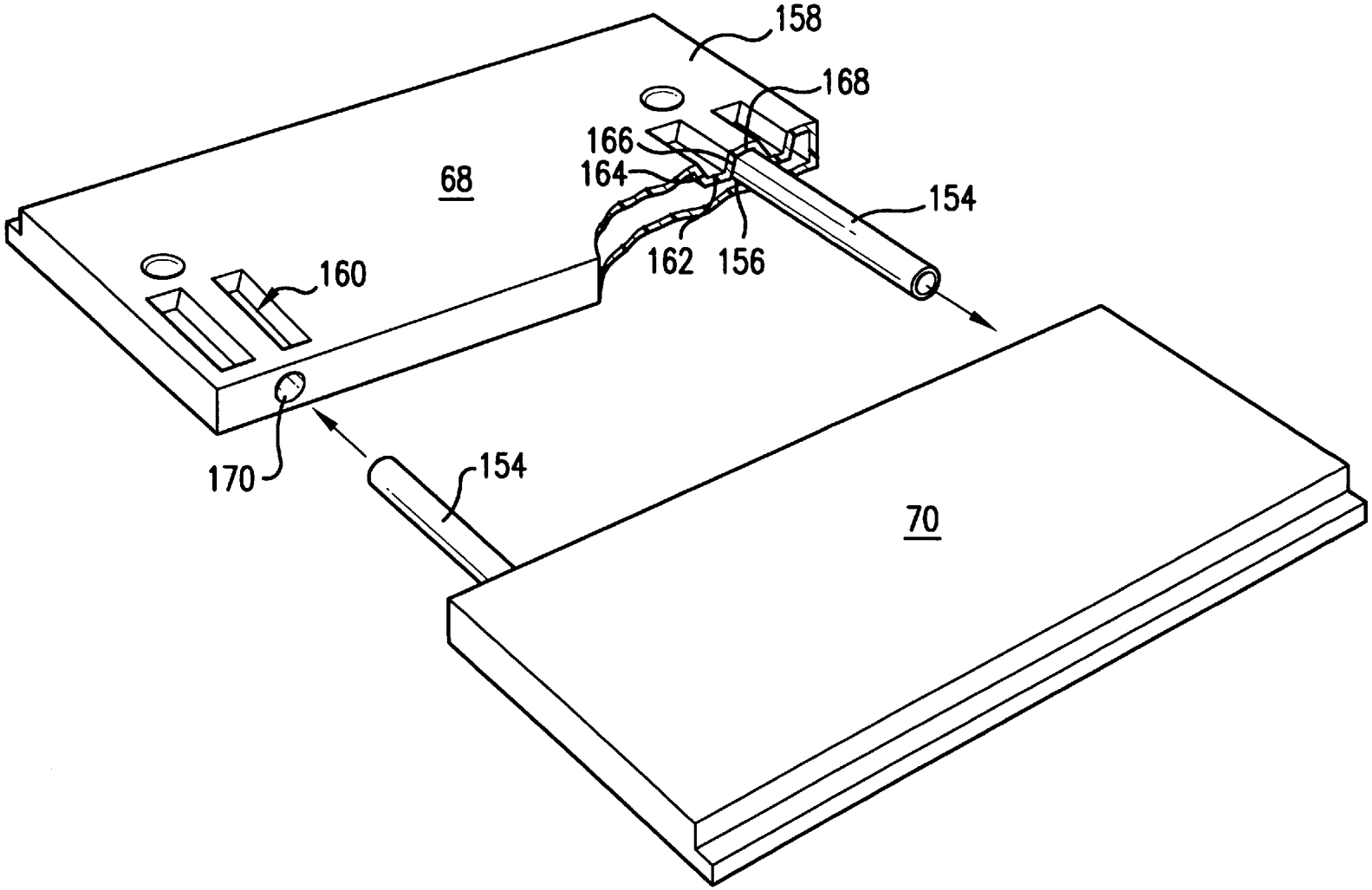
FIG. 5 is an exploded cut-away bottom view of two table top pieces that can be used to assemble a table top for use in the storage case of FIG. 1.

FIG. 5 illustrates a cut-away bottom view of a portion of the panel 68. The bottom side 158 of the panel 68 has a plurality of recesses 160 that are configured to receive the ridges 48 on the top panel 36 of the lid 26. The recesses 160 are configured with a bottom section 162 and two wall sections 164 and 166 extending from the bottom section 162 at an angle such that the distance between the wall sections 164 and 166 is greater at the bottom side 158 of the panel 68 than at their connection with the bottom section 162. Two adjacent recesses 160 define a channel 156. The wall sections 164, 166 of the two adjacent recesses 160 provide the channel 156 with a configuration in which the upper part 168 of the channel 156 is narrower than the central part of the channel 156. The channel 156 communicates with an opening 170 through which a tube 154 can be inserted. The narrowed upper part 168 of the channel 156 operates to grip the tube 154 to provide a more secure connection of the tube 154 inside the channel 156. This in turn ensures that the adjacent panels 68, 70, 72, 74 that are connected by similar tubes 154 form a stable table top 75. The other panels 70, 72 and 74 are likewise provided with recesses 160 that define the channels 156 described above. Although FIGS. 1 and 5 illustrate the use of two tubes 154 and two channels 156 for connect adjacent table top panels, it is possible to provide any number of tubes 154 and corresponding channels 156. The tubes 154 can be stored in the internal compartment 20 for transportation.

The corresponding ridges 48 and recesses 160 provide a secure and stable mechanism for retaining the table top 75 on top of the storage case 10. In this regard, the ridges 48 may be provided with the same configuration as the recesses 160 described above. To provide a more secure connection, it is also possible to additionally provide a fastener, such as a threaded screw, dzus fastener, or quarter-turn fastener, on one of the panels 68, 70, 72 or 74, to secure it to a corresponding coupler, such as a threaded opening, dzus clip, or quarter-turn receptacle, provided in the top panel 36 of the lid 26. In addition, although the table top 75 is shown as comprising four panels 68, 70, 72 and 74, any number of panels can be provided to assemble the table top 75.

Figure 6:
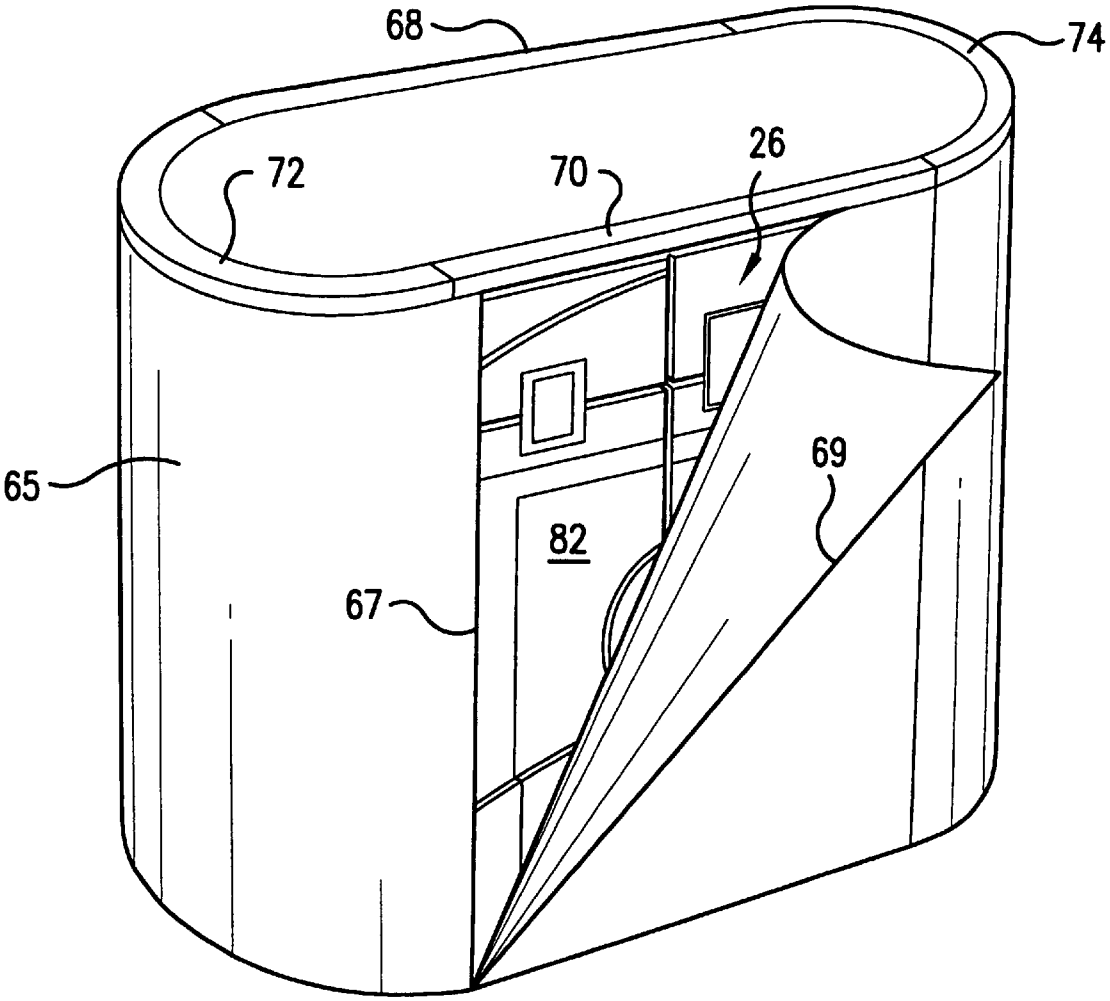
FIG. 6 is a perspective view of the storage case of FIG. 1 shown in use as a display cabinet and table with a decorative skirt surrounding the storage case.

Referring now to FIG. 6, a decorative skirt 65 may be used to cover the sides of the storage case 10 when it is being used as a combined storage cabinet and table. The top edges of the decorative skirt 65 can be removably secured to the storage case 10 or the table top 75 by Velcro™, clips or other conventional removable affixation means, and the skirt 65 wrapped around the storage case 10 and the table top 75. The opposing ends 67, 69 of the skirt 65 can then be secured together by similar conventional removable affixation means. As a result, if the exhibitor wishes to access the interior compartment 20 of the storage case 10, the exhibitor can peel away the opposing ends 67, 69 and open the doors 80, 82. The decorative skirt 65 provides an aesthetically attractive set-up for the storage cabinet and table, and is optional.

Those skilled in the art will appreciate that the embodiments and alternatives described above are non-limiting examples only, and that certain modifications can be made without departing from the spirit and scope thereof. The accompanying claims are intended to cover such modifications as would fall within the true scope and spirit of the present invention.

For example, although the storage case 10 (i.e., its walls 12, 14, 16, 18 and the bottom panel 21) is preferably provided in one integral unit, it can also be made by providing separate wall pieces and connecting these pieces by conventional connection techniques. Score lines and/or corrugations can also be provided on the outer surfaces of any of the walls or doors of the storage case 10 to enhance the visual appearance of the storage case 10.

What is claimed is:

1. A storage case, comprising:

a plurality of walls surrounding an internal compartment and including a front wall;

a door provided in the front wall for providing access to the internal compartment;

a top panel for covering the internal compartment;

a removable table top assembly resting on the top panel, the table top assembly having a plurality of table top panels that are removably coupled together to form the table top assembly, the table top panels adapted to be stored in the internal compartment; and a shelf provided in the internal compartment, and wherein the shelf further includes a lever arm pivotably coupling the shelf and one of the plurality of walls inside the internal compartment, wherein the shelf may be pivoted between a vertical position adjacent the front wall, and a horizontal position across the internal compartment.

2. The storage case of claim 1, further comprising a base panel between the plurality of walls, and a set of wheels provided adjacent the base panel.

3. The storage case of claim 2, further comprising a handle provided on one of the walls.

4. The storage case of claim 3, further comprising a lid hingedly connected to one of the walls, the lid including the top panel.

5. The storage case of claim 1, where in the door has a hollow interior and includes a locking mechanism, the locking mechanism comprising a locking wheel having a pair of bars extending vertically in opposite directions from the wheel, each bar housed within the hollow interior of the door and, when the lock is activated, is extended from the hollow interior and into the internal compartment adjacent the front wall to prevent the door from being opened.

6. The storage case of claim 5, wherein the locking mechanism further includes a lock and a lever arm having first and second ends, the first end coupled to the locking wheel and the second end having a finger for locking engagement with the lock.

7. A storage case, comprising:

a plurality of walls surrounding an internal compartment and including a front wall;

a door provided in the front wall for providing access to the internal compartment;

a top panel for covering the internal compartment;

a removable table top assembly resting on the top panel, the table top assembly having a plurality of table top panels that are removably coupled together to form the table top assembly, the table top panels adapted to be stored in the internal compartment;

a plurality of tubes; and wherein the table top panels include a bottom surface and a plurality of recesses on the bottom surface, each recess having two wall sections separated by a bottom section, with the wall sections of adjacent recesses defining a channel for receiving one of the plurality of tubes; and wherein the two wall sections of each recess are angled with respect to each other such that the two wall sections are closest to each other adjacent the bottom section and furthest from each other adjacent the bottom surface of the table top panel.

8. The storage case of claim 7, further including a plurality of ridges on the top panel for insertion into corresponding recesses on the bottom surfaces of the table top panels.

9. A storage case, comprising:

a plurality of walls surrounding an internal compartment and including a front wall;

a door provided in the front wall for providing access to the internal compartment;

a base panel between the plurality of walls, and a set of wheels provided adjacent the base panel; and a shelf provided in the internal compartment, the shelf further including a lever arm pivotably coupling the shelf and one of the plurality of walls inside the internal compartment, wherein the shelf may be pivoted between a vertical position adjacent the front wall, and a horizontal position across the internal compartment.

10. The storage case of claim 9, further comprising a handle provided on one of the walls.

11. The storage case of claim 9, wherein the door has a hollow interior and includes a locking mechanism, the locking mechanism comprising a locking wheel having a pair of bars extending vertically in opposite directions from the wheel, each bar housed within the hollow interior of the door and, when the lock is activated, is extended from the hollow interior and into the internal compartment adjacent the front wall to prevent the door from being opened.

12. The storage case of claim 11, wherein the locking mechanism further includes a lock and a lever arm having first and second ends, the first end coupled to the locking wheel and the second end having a finger for locking engagement with the lock.

13. The storage case of claim 9, further comprising:

a top panel for covering the internal compartment; and a table top assembly resting on the top panel, the table top assembly including:

a plurality of table top panels that are coupled together to form the table top assembly, the table top panels including a bottom surface and a plurality of recesses on the bottom surface, each recess having two wall sections separated by a bottom section, with the wall sections of adjacent recesses defining a channel; and a plurality of tubes, with each tube received in corresponding channels of adjacent table top panels;

wherein the table top panels are adapted to be stored in the internal compartment.

14. In combination:

(a) a modular display system having a plurality of collapsible frames, each frame having a plurality of foldable legs; and (b) a storage case having: a shelf;

at least three walls surrounding an internal compartment that defines an open uninterrupted space and including a front wall;

a door provided in the front wall for providing access to the internal compartment; and wherein the plurality of collapsible frames and the shelf are stored in the internal compartment of the storage case when the storage case is in a storage mode with the shelf being substantially vertical; and wherein the plurality of collapsible frames are removed from the internal compartment, and the shelf is positioned horizontally in the internal compartment, when the storage case is used as a table.

15. The combination of claim 14, wherein the storage case further includes a top panel for covering the internal compartment.

16. The combination of claim 15, wherein the storage case further includes a removable table top assembly resting on the top panel, the table top assembly having a plurality of table top panels that are removably coupled together to form the table top assembly, the table top panels adapted to be stored in the internal compartment.

17. The combination of claim 14, wherein the storage case further includes a base panel extending between the plurality of walls, and a set of wheels provided adjacent the base panel.

18. The combination of claim 17, wherein the storage case further includes a handle provided on one of the walls.

19. The combination of claim 15, wherein the storage case further includes a lid hingedly connected to one of the walls, the lid including the top panel.

20. The combination of claim 14, wherein the door has a hollow interior and includes a locking mechanism, the locking mechanism comprising a locking wheel having a pair of bars extending vertically in opposite directions from the wheel, each bar housed within the hollow interior of the door and, when the lock is activated, is extended from the hollow interior and into the internal compartment adjacent the front wall to prevent the door from being opened.

21. The combination of claim 20, wherein the locking mechanism further includes a lock and a lever arm having first and second ends, the first end coupled to the locking wheel and the second end having a finger for locking engagement with the lock.

22. The combination of claim 14, wherein the shelf further includes a lever arm pivotably coupling the shelf and one of the plurality of walls inside the internal compartment, wherein the shelf may be pivoted between a vertical position adjacent the front wall, and a horizontal position across the internal compartment.

23. The combination of claim 16, further including a plurality of tubes, and wherein the table top panels include a bottom surface and a plurality of recesses on the bottom surface, each recess having two wall sections separated by a bottom section, with the wall sections of adjacent recesses defining a channel for receiving one of the plurality of tubes.

24. The combination of claim 23, wherein the two wall sections of each recess are angled with respect to each other such that the two wall sections are closest to each other adjacent the bottom section and furthest from each other adjacent the bottom surface of the table top panel.

25. The combination of claim 24, further including a plurality of ridges on the top panel for insertion into corresponding recesses on the bottom surfaces of the table top panels.

* * * * *